US006425745B1

(12) United States Patent
Lavin

(10) Patent No.: US 6,425,745 B1
(45) Date of Patent: Jul. 30, 2002

(54) SURFACE TREATMENT OF HELICALLY-PROFILED ROTORS

(75) Inventor: Philip Anthony Lavin, Hexham (GB)

(73) Assignee: Monitor Coatings and Engineers Limited (GB)

( * ) Notice: Subject to any disclaimer, the term of this patent is extended or adjusted under 35 U.S.C. 154(b) by 0 days.

(21) Appl. No.: 09/622,730

(22) PCT Filed: Feb. 19, 1999

(86) PCT No.: PCT/GB99/00528

§ 371 (c)(1),
(2), (4) Date: May 3, 2001

(87) PCT Pub. No.: WO99/42632

PCT Pub. Date: Aug. 26, 1999

(30) Foreign Application Priority Data

Feb. 19, 1998 (GB) ..... 9803561

(51) Int. Cl.[7] ..... F01C 1/107; F03C 2/08; B05B 13/04; C23C 4/14

(52) U.S. Cl. ..... 418/48; 418/178; 118/321; 118/696; 427/450; 427/596

(58) Field of Search ..... 418/48, 178; 118/321, 118/323, 669, 683, 684, 686, 696; 427/255.5, 448, 450, 596

(56) References Cited

U.S. PATENT DOCUMENTS 2,864,334 A * 12/1958 Stocker ..... 118/321
5,120,204 A * 6/1992 Mathewson et al. ..... 418/48
5,145,710 A 9/1992 Quadflieg et al. ..... 427/34
5,968,603 A * 10/1999 Urbanek et al. ..... 427/450

FOREIGN PATENT DOCUMENTS

| | | |
|---|---|---|
| EP | 0 627 556 A1 | 12/1994 |
| EP | 0 795 620 A1 | 9/1997 |
| FR | 735092 | 6/1969 |

OTHER PUBLICATIONS

Patent Abstracts of Japan. Application No.: 61,073,847, filed Mar. 31, 1986; Inventor: Tani Kazumi; Title: Step Roll For Single Facer and Its Manufacture.

Patent Abstracts of Japan. Application No.: 59,050,590, filed Mar. 16, 1984; Inventor: Morishita Toru; Title: Thermal Spraying Method.

* cited by examiner

*Primary Examiner*—John J. Vrablik
(74) *Attorney, Agent, or Firm*—Cesari and McKenna, LLP

(57) ABSTRACT

A treatment jet or beam, e.g. from a high velocity oxygen-liquid fuel (HVOF) spray gun, has an axis intersecting the surface of a rotor at a given point. The rotor has a profile which progresses helically along it. The point is traversed along the rotor while keeping the point at the same position on the rotor profile. In particular the jet axis is moved parallel to the rotor axis while the rotor is rotated in synchronism.

15 Claims, 2 Drawing Sheets

SURFACE TREATMENT OF HELICALLY-PROFILED ROTORS

This invention relates to the surface treatment, in particular coating, of rotors having a profile which progresses helically along the rotor.

Down-hole drilling motors have a multi-lobed rotor which is surrounded by an elastomer stator with "negative" lobes which mate with the lobes of the rotor. The lobed profile scrolls down the length of the rotor (which can be up to 6 meters in length) and the spiral path of the lobes often wraps around the rotor length more than one full turn. The stator has an extra lobe, which allows drilling muds to be pumped down the motor, and the force of these fluids imparts a rotary motion to the rotor, which provides the driving force for the drill bits attached to the end of the motor.

In the past, the rotors have been chromium plated to protect them from corrosion and to provide a surface compatible with that of the elastomer stator. However, wells are now being drilled in more difficult geological structures and this requires drilling muds which are more corrosive because of the content of various salts (e.g. sodium chloride) which can be as high as 300,000 ppm. Hard chromium plating always contains cracks and the corrosive drilling muds can penetrate these cracks and initiate corrosion between the chromium plate and the substrate material. In a very short space of time (sometimes as little as 20 hours) the corrosion products cause the chromium plate to separate from the substrate material and these separate pieces of chromium together with the corrosion products themselves attack and destroy the profile of the elastomer stator, which in turn reduces the drilling performance of the motor to unacceptable levels.

It has now been demonstrated that a composite WC/ceramic coating such as described in GB-A-2 269 392 can out-last chromium plating to such an extent that the new coating is being considered as a replacement for chromium plating of rotors. However, there are many thousands of rotors in the industry's "fleets" and all of these rotors have been machined to specific sizes to accept the normal chromium plating thicknesses. The size tolerances between rotor and stator are obviously of major importance in defining motor performance. Because the chromium plate is applied electrolytically, the lobe peaks generate a higher current density in the plating baths than the valleys and, consequently, a thicker coating is deposited on the peaks (450–500 $\mu$m) than is deposited in the valleys (75–100 $\mu$m) between the peaks. In contrast a WC/ceramic composite coating is deposited by the combination of a high velocity oxygen-liquid fuel (HVOF) technique and a thermochemical deposition technique, but coating thickness is largely dictated by the HVOF technique.

The HVOF technique is a particular form of flame spraying technique. A cylindrical component to be coated is revolved at a precise speed whilst the deposition "spot" generated by the coating torch or gun is traversed along the length of and on the centre-line of the component at a speed which is matched to the speed of rotation so that the spot follows a tight helical path. A coating of uniform longitudinal thickness is achieved when the pitch of the helical deposition path is less than the diameter of be deposition spot. The cross-sectional thickness of an HVOF coating deposited in this matter on a rotor is effectively dictated by the major and minor diameters of the rotor profile. Thus, if the major diameter (lobe peak) is twice that of the minor diameter (lobe valley), then the coating thickness in the valleys will be twice that of the peaks. Depending upon the number of lobes on a rotor (and thus the slope of the valley sides) the thickness in the valleys can be further increased by a funnelling or concentrating effect on the coating deposition spot.

Thus the natural coating thickness profile deposited by the conventional HVOF technique is completely opposite to that of chromium plating techniques and they are different to such an extent that the desired "fit" between rotors and standard stators can only be achieved by machining a new rotor to a specific size to accommodate the natural coating profile of the conventional HVOF coating. However, this would mean that the many thousands of rotors in the existing fleets could not be coated by the WC/ceramic composite coating technique and many of them would have to be scrapped because of the severity of the corrosion problems. Because of the slope variations created by the major and minor diameters of the cross-sectional profile of the rotors, it is difficult to ensure that the angle between the coating deposition plane and the coating stream is maintained at the optimum 90° when coating on the longitudinal centre-line of the rotor. Thus coating quality and bond strength cannot be optimised uniformly around the rotor.

The present invention provides a method of treating the surface of a rotor having a profile which progresses helically along the rotor, comprising providing a treatment jet or beam having an axis intersecting the surface of the rotor at a point, and traversing the point along the rotor while keeping the point at the same position on the profile.

The invention also provides apparatus for performing the method.

The invention will be described further, by way of example, with reference to the accompanying drawings, in which.

Figure 1:
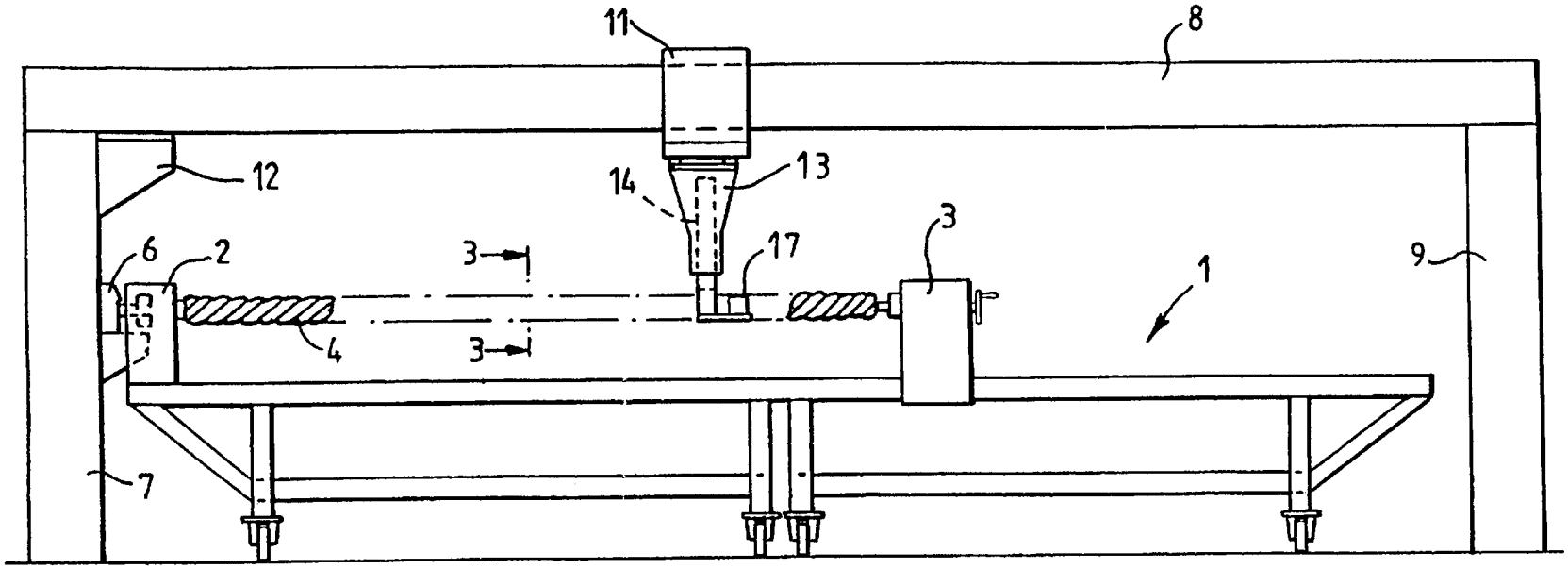
FIG. 1 is a side elevation of an installation for coating a lobed rotor.
Figure 2:
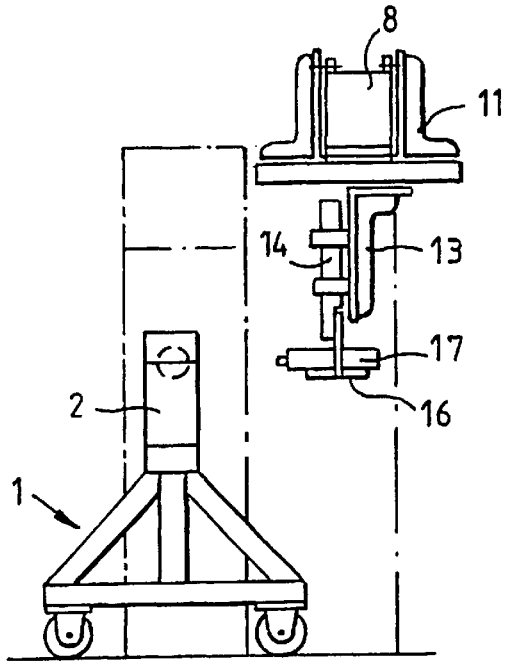
FIG. 2 is an end view of the installation.

The installation comprises a stand 1 having a headstock 2 and a longitudinally adjustable tailstock 3 for supporting a rotor 4 for a down-hole motor. The headstock 2 engages with a rotor drive 6 carried by a column 7. A gantry 8 extends parallel to the rotor 4 from the column 7 to another column 9. A carriage 11 runs along the gantry 9 and is driven by a traversing drive 12.

The carriage 11 has a bracket 13 which is movable horizontally towards and away from the rotor 4 and which carries a vertically movable post 14. Suspended from the lower end of the post 14 is a table 16 supporting an HVOF spray gun 17, which is optionally tiltable to alter the angle of the axis 18 of the coating jet 19 relative to the horizontal.

Figure 3:
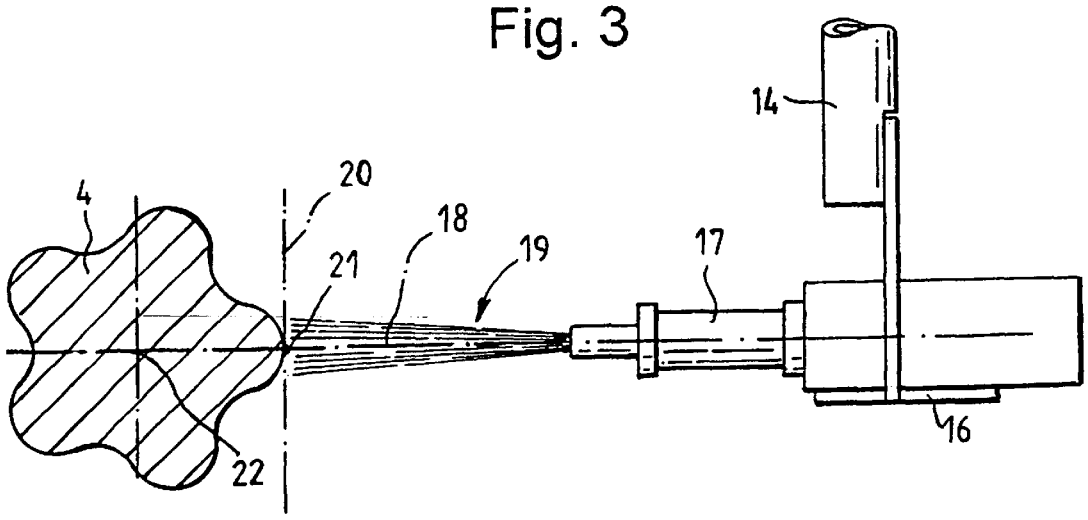
FIG. 3 is an enlarged section on line 3—3 in FIG. 1.

As shown in FIG. 3, the axis 18 of the coating jet 19 intersects the surface of the rotor 4 at an angle of 90° to the tangent 20 to the rotor profile at the intersection point 21 (which in this case is at the peak of a lobe). The jet axis 18 also intersects the rotor axis 22. As the carriage 11 is traversed along the gantry 8 the rotor 4 is rotated at such a speed that the intersection point 21 stays at the same position on the rotor profile (i.e., at the peak of the same lobe, in this case). The rotary drive 6 and the traversing drive 12 are synchronised for this purpose, by computer control, according to a predetermined program.

After one complete traverse of the rotor 4, the gun 17 has deposited a ceramo-metallic coating (e.g. WC-Co) in a narrow band along the peak of one spiral lobe. The rotor 4 is then rotated through a small angle relative to the gun 17 so that the intersection point 21 is moved to a new position (adjacent the band of coating) on the rotor profile. If necessary, the gun 17 is tilted so that the jet axis 18 intersects the rotor surface at 90°. The gun 17 is then traversed along the rotor 4 again, while the rotor 4 is rotated in synchronism. The speed of traverse is chosen to achieve the desired thickness of the coating layer. Any required thickness of coating can be achieved by suitable superimposition or overlapping of successive layers.

The installation enables the deposition of WC/ceramic composite coatings onto rotors to any desired thickness profile and without any compromise in coating quality. In order to optimise coating quality and bond strength, it is preferable to deposit the coating so that the angle of the coating stream to the deposition plane is near to 90°. Using the above-described coating installation, the coating deposition spot can be targeted at any specific point on the cross-section of the lobed rotor and, by synchronising the rotational and traverse speed, the deposition spot can be traversed along the length of the rotor but with the coating spot remaining all the time on the same cross-sectional position of the lobed profile. By adjusting the angle of the coating torch, the deposition angle can be maintained near to 90° and thus the coating quality can be optimised.

The coating torch traverse speed is fast enough to ensure that a minimum coating thickness is deposited in each pass so that the internal stress in each layer of coating is not too high. This relatively high traverse speed requirement means that synchronization has to be controlled carefully because the acceleration and deceleration ramps of the traverse drive (and the weight of the coating torch) have to be taken into account and the end overspray allowances to accommodate these ramps (thus ensuring uniform traverse speed and deposition along the rotor) can be considerable. Synchronization of rotation and traverse speeds is achieved and controlled by electronic encoders linked to special motor drives, and a complete coating program which defines the number of coating layers at any cross-sectional position, indexes from one longitudinal coating track to the next around the entire 360° of the rotor profile, and adjusts the coating torch angle required for each coating track can be loaded into the controlling computer.

If the spray stream of the coating gun or torch is traversed across a flat surface, a coating track is formed which has a maximum width of approx. 30 mm, for example, although the thickness across the track is not uniform: a 10 to 15 mm wide plateau is formed in the middle of the deposition track and the thickness approaches zero at each side of the 30 mm wide band. The coating thickness deposited during each individual traverse is dependent upon the parameter settings of the coating torch, such as powder feed rate (typically set at 4.75 kg/h) but the plateau coating thickness in each track is also dependent upon the traverse speed. In order to minimise beat transfer to the component and to reduce residual coating stress, it is preferable to adjust the traverse speed so that the coating is deposited in tracks with a maximum thickness of 25 $\mu$m at the plateau position, with each track overlapping its adjacent track by 5 to 10 mm. The amount of track overlap on a rotor is controlled by the degree of rotational index of the rotor after each traverse of the complete length of the rotor. The angle of the spray stream between the torch and substrate can be varied by a gun tilt mechanism (controlled by the computer program) to compensate for variation in angular presentation of the coating deposition point as the deposition tracks progress around the rotor circumference from lobe peak to valley via the flanks of each lobe. Thus the coating/substrate angle can be maintained at or near to 90° to ensure that the coating density, bond strength, and hardness are always optimised at every position on the rotor surface. The final coating thickness can be tailored to any desired finished coating thickness profile around the circumference of the rotor by selecting and depositing the requisite number of repeated passes over a particular point on the rotor surface.

The above-described process produces a rotor with a treated surface having a profile which progresses helically along the rotor, the treated surface exhibiting treatment tracks (in particular coating tracks) which progress helically along the rotor.

Thus, the synchronised coating technique allows a WC/ceramic composite coating to be built-up to any desired thickness profile by depositing the coating in slightly overlapping tracks along the length of the rotor. By depositing more coating layers on the peaks of the lobes than in the valleys between the lobes, it is possible to replicate chromium plating thickness profiles and thus it is possible to apply a WC/ceramic composite coating to those existing rotors which have been machined to accept the chromium plating thickness specification. Also, depending upon the direction of rotation, the flanks on one side of the lobe peaks are effectively "thrust faces" and therefore greater wear imposed by the abrasive drilling muds is evident at these positions. The synchronised coating technique allows the coating thickness to tailored to meet the greater wear rate at these positions.

Various modifications may be made within the scope of the invention.

For example, although the coating technique has been described in the context of the use of an HVOF gun, it is applicable to any other coating spray gun. Furthermore, the invention is applicable not only to coating but also to other forms of surface treatment, e.g. using energy beams, such as laser beams.

Although the gun has been shown as being mounted to one side of the rotor, it may be preferable to suspend the gun above the rotor (so that any sagging of the rotor does not have an adverse effect).

I claim:

1. A method of treating the surface of a rotor having a profile which progresses helically along the rotor, comprising the steps of:

(a) providing a treatment jet or beam having an axis intersecting the surface of the rotor at a point; and (b) traversing the point of intersection along the rotor, wherein, during step (b), the point of intersection is kept at the same position on the profile.

2. A method as claimed in claim 1, including, after step (b), (c) moving the treatment jet or beam relative to the rotor so that the said axis intersects the surface of the rotor at another point;

(d) traversing this point of intersection along the rotor while keeping this point at the same position on the profile; and (e) repeating steps (c) and (d).

3. A method as claimed in claim 2, in which the angle between the said axis and the profile of the rotor at the point of intersection is kept substantially the same.

4. A method as claimed in claim 3, in which the said angle is substantially 90°.

5. A method as claimed in any of claims 2 to 4, in which steps (b) and (d) form treatment tracks which overlap.

6. A method as claimed in any of claims 1 to 4, in which the point of intersection is traversed along the rotor by moving the treatment jet or beam along a straight path parallel to the rotor, and the point is kept at the same position on the profile by rotating the rotor in synchronism with the movement of the treatment or beam.

7. A rotor with a treated surface produced by a method according to any of claims 1 to 4.

8. Apparatus for treating the surface of a rotor having a profile which progresses helically along the rotor, comprising:

(a) a stand for supporting the rotor so that it is rotatable about its axis;

(b) a carriage mounted so as to be movable reactive to the stand along a straight path parallel to the rotor axis;

(c) a treatment gun for producing a treatment jet or beam directable at the rotor when supported on the stand, the treatment gun being carried by the carriage;

(d) a rotary drive for rotating the rotor when supported on the stand;

(e) a traversing drive for moving the carriage; and (f) control means for synchronising the operation of the rotary and traversing drives to rotate the rotor in synchronism with the traversing movement so that the point at which the axis of the treatment jet or beam intersects the surface of the rotor traverses along the rotor while remaining at the same position on the profile of the rotor.

9. Apparatus as claimed in claim 8, in which the treatment gun is tiltable.

10. Apparatus as claimed in claim 8 or 9, in which the treatment gun is movable towards and away from the rotor when supported by the stand.

11. A rotor with a treated surface having a profile which progresses helically along the rotor, the treated surface exhibiting treatment tracks which progress helically along the rotor, each treatment track remaining at the same position on the profile.

12. A rotor as claimed in claim 11, in which the treatment tracks are coating tracks.

13. A rotor as claimed in claim 12, in which the coating tracks substantially consist of ceramo-metallic material.

14. A rotor as claimed in any of claims 11 to 13, in which the treatment tracks overlap one another.

15. A rotor as claimed in any of claims 11 to 12, in which the profile of the rotor has a plurality of lobes.

* * * * *